United States Patent [19]

Biehl

[11] Patent Number: 4,932,445

[45] Date of Patent: Jun. 12, 1990

[54] SUBSURFACE FILLER

[76] Inventor: Bruce D. Biehl, 110 Drywood Pl., Cary, N.C. 27513

[21] Appl. No.: 211,710

[22] Filed: Jun. 27, 1988

[51] Int. Cl.[5] ..... B65B 3/28

[52] U.S. Cl. ..... 141/83; 141/87; 141/88; 141/93; 141/263; 141/284; 177/DIG. 7

[58] Field of Search ..... 141/1, 5, 392, 83, 98, 141/86, 87, 88, 93, 250, 251, 255, 263, 266, 270, 283, 284, 374, 89, 90; 177/DIG. 7

[56] References Cited

U.S. PATENT DOCUMENTS

| | | | |
|---|---|---|---|
| 2,283,093 | 5/1942 | Rosenthal et al. | 141/374 |
| 2,451,451 | 10/1948 | Tate | 177/DIG. 7 |
| 2,654,557 | 10/1953 | Henderson | 177/DIG. 7 |
| 2,709,539 | 5/1955 | Swanson, Jr. | 141/87 X |
| 2,750,091 | 6/1956 | Mattimoe et al. | 141/89 |
| 2,812,919 | 11/1957 | Guerard | 177/1 |
| 3,447,281 | 3/1969 | Buford et al. | 141/87 X |
| 3,608,656 | 9/1971 | Pettis, Jr. | 177/DIG. 7 |
| 3,626,998 | 12/1971 | Trusselle | 141/198 |
| 3,994,117 | 11/1976 | Kinney | 53/77 |
| 4,127,434 | 11/1978 | Lass | 156/526 |
| 4,211,263 | 7/1980 | Kennedy et al. | 141/83 |
| 4,337,802 | 7/1982 | Kennedy et al. | 141/1 |
| 4,494,583 | 1/1985 | Reeves, Jr. et al. | 141/83 |
| 4,549,620 | 10/1985 | Dee et al. | 177/DIG. 7 |
| 4,573,502 | 3/1986 | Hurley et al. | 141/1 |
| 4,677,931 | 7/1987 | Buckle | 114/331 |
| 4,703,780 | 11/1987 | Reeves, Jr. et al. | 141/1 |
| 4,735,238 | 4/1988 | Reeves, Jr. | 141/1 |

OTHER PUBLICATIONS

Copies of valve descriptions in equipment catalogs (Clippard Instrument Laboratory, Inc., Cincinnati, OH).

*Primary Examiner*—Ernest G. Cusick
*Attorney, Agent, or Firm*—Lynn E. Barber

[57] ABSTRACT

A subsurface filler comprising a pneumatically controlled scale, timer, lance descent and ascent mechanism, liquid fill mechanism, movable drip tray and exhaust mechanism. The filler may be used with different sizes of containers and with hazardous and noxious liquids.

6 Claims, 6 Drawing Sheets

54
31
18
55
48
41
37
59
30
29
3 UP
3 DOWN
4 IN
4 OUT
38 CLOSE
FROM 17 CLOSE
34 BOTTOM IN
42 OPEN
34 TOP OUT
42 CLOSE
PNEUMATIC SUPPLY
17 SUPPLY
49 IN
38 OPEN
19 RETRACT
19 EXTEND
34 BOTTOM OUT
34 TOP IN
FROM 17 OPEN
23 IN
23 OUT
49 OUT

SUBSURFACE FILLER

BACKGROUND OF THE INVENTION

1. Field of the Invention

This invention relates to an apparatus for filling containers with a particular weight of liquid and, more particularly, to a subsurface filling apparatus having a pneumatically-controlled lance assembly.

2. Description of the Related Art

A number of types of equipment have been designed for filling large containers. With liquids susceptible to foaming, the lower discharge end of the lance that is used for filling the container is often placed near the bottom of the container. The drum filling apparatus disclosed by Reeves, Jr. et al. (U.S. Pat. No. 4,703,780) has such a subsurface lance that utilizes a weight-responsive apparatus that automatically raises the filling lance during the filling operation so that only a small portion of the lance remains below the liquid surface. This patent and all other cited patents are hereby incorporated by reference. This apparatus has two fill rates (an initial fast rate followed by a final dribble fill) with which the rate of rise of the lance is coordinated. One signal generator causes a lowering movement of the lance, and a second signal generator operating in cooperation with the weight-responsive apparatus causes the upward lance movement. This invention does not disclose a fully pneumatic subsurface filler and thus presents potential explosion problems with low TLV gases (OSHA's threshold limit values).

An earlier patent of Kennedy et al. (U.S. Pat. No. 4,337,802) also has an automatically withdrawn lance while the discharge end of the lance remains beneath the surface of the liquid. A first signal generator actuates downward movement of the lance. The second signal generator is actuated by the downward movement of the lance. A delay mechanism, actuatable by the second signal generator causes the fast fill, and a third signal generator, actuated by the rise of the lance to a predetermined height, causes the lance to stop movement. Initiation of the termination of the liquid flow and upward movement of the lance are actuated by a second control signal form the second signal generator when a predetermined weight is reached. Again, this filler is not fully pneumatic. Furthermore, it has many machined parts, parts that are potentially exposed to corrosive fumes, and parts that are relatively inaccessible. These features increase the cost of the filler, and make it expensive and/or difficult to use and to maintain.

Another problem found in subsurface filling is that of drip collection. To solve this problem, the apparatus disclosed in U.S. Pat. No. 4,337,802 has a drip collection assembly consisting of a movable drip pan, a fixed drip outlet tray and a drainage hose. The movement occurs by a piston-cylinder assembly controlled by pneumatic circuitry. This apparatus also has a wiper ring assembly through which the lance is withdrawn and which serves to remove the liquid from the surface of the lance.

Noxious vapors are often a problem with subsurface fillers. Many of the exhaust systems of subsurface fillers are not designed for efficient removal of large quantities of harmful liquid vapors, and a dangerous vapor buildup may occur. The vapors and corrosive liquids may also harm the parts of the filler. Thus, these parts require considerable maintenance time and replacement parts.

Subsurface fillers generally have one or more electronic controls. This presents a problem when explosive vapors are ignited by an electronic signal. To avoid this problem, explosion-proof fillers must be constructed for use with explosive vapors, which increases the cost of the fillers.

Because subsurface fillers are generally constructed of many machined parts, they are expensive to construct and to buy even if not constructed to be explosion-proof. It is therefore an object of this invention to provide a subsurface filler that has few machined parts and is relatively inexpensive.

It is a further object of this invention to provide a subsurface filler that enables accurate filling of a container.

It is a further object of this invention to provide a subsurface filler that has easily controlled lance movement while the discharge end of the lance remains beneath the surface of the liquid.

It is another object of this invention to provide a subsurface filler that is entirely pneumatically controlled.

It is another object of this invention to provide a subsurface filler that has a pneumatically activated drip tray.

It is a further object of this invention to provide a subsurface filler that has an efficient exhaust system for noxious gases.

It is a further object of this invention to provide a subsurface filler that requires little maintenance and has a long useful life.

Other objects and advantages of the invention will be more fully apparent from the ensuing disclosure and appended claims.

SUMMARY OF THE INVENTION

The subsurface filler of the invention is entirely pneumatically controlled. The subsurface filler thus comprises a pneumatically controlled scale, timer, lance descent and ascent mechanism, liquid fill mechanism, movable drip tray mechanism and exhaust mechanism.

Other aspects and features of the invention will be more fully apparent from the following disclosure and appended claims.

DETAILED DESCRIPTION OF THE INVENTION AND PREFERRED EMBODIMENTS THEREOF

Figure 1:
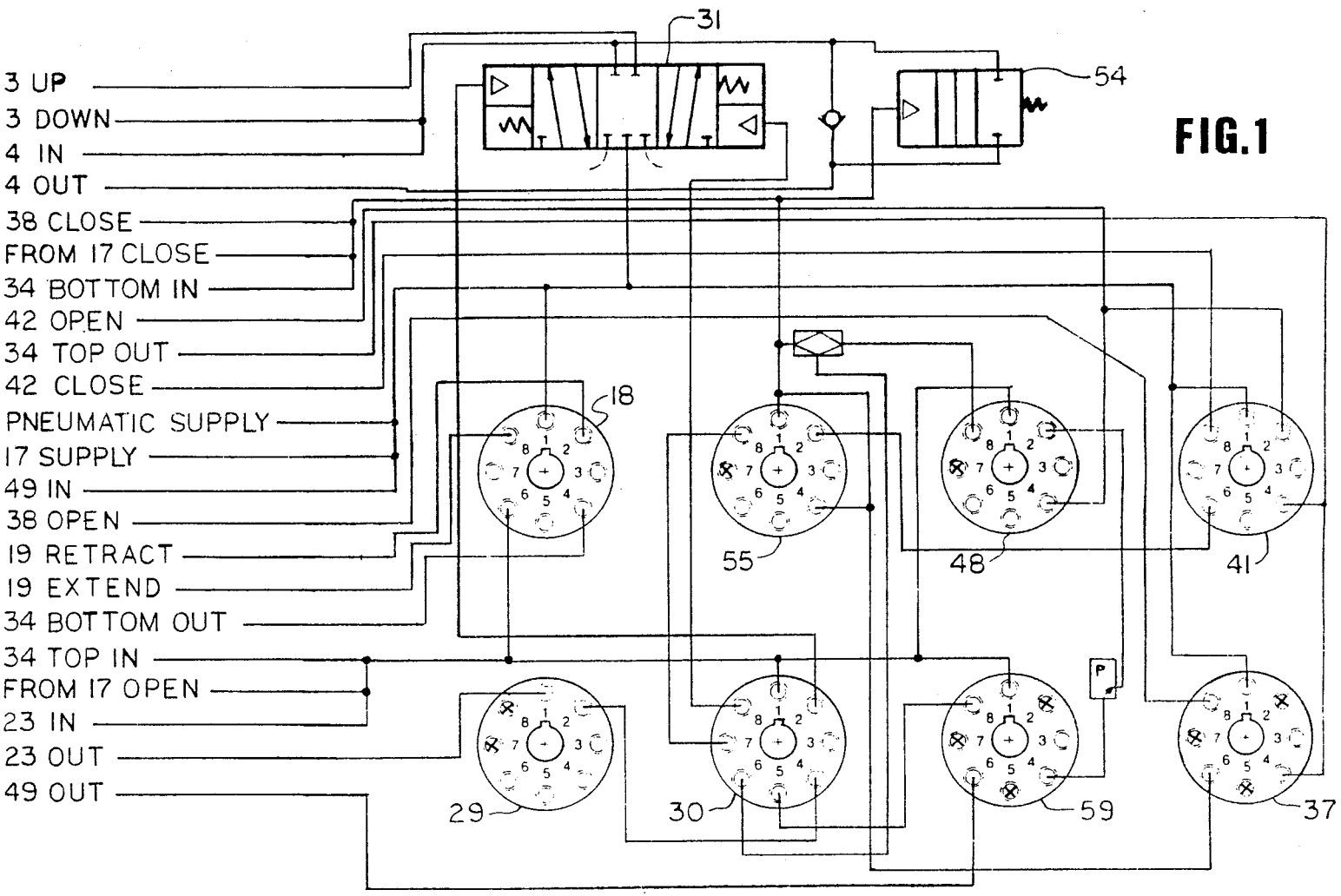
FIG. 1 is a schematic diagram of the circuit in the pneumatic sequencer control box.
Figure 2:
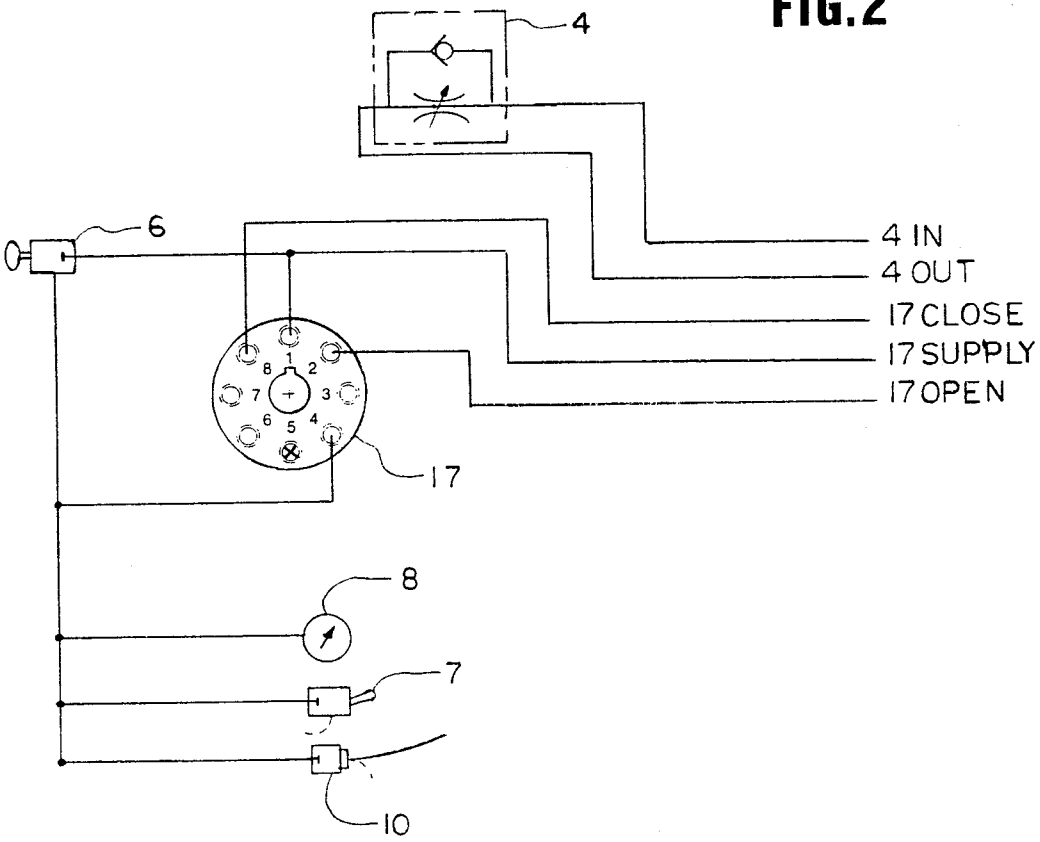
FIG. 2 is a schematic diagram of the operator control box.

An important part of the invention is the inclusion of the pneumatic sequencer control box 1 and the pneumatic operator control 2. A schematic circuit diagram of the pneumatic sequencer control box 1 is shown in FIG. 1 and of the pneumatic operator control 2 in FIG. 2. The preferred embodiment of each of these is made by Tipler Corp. (Downers Grove, IL). The valves and switches in the apparatus of the invention are connected by pneumatic tubing as are known in the art and are not shown in the figures. The pneumatic sequencer control box 1, the components of which are discussed in detail below, is used in conjunction with a pneumatic cylinder apparatus 3. In the preferred embodiment, the pneumatic cylinder apparatus 3 used in this invention is the TRAC TROL TM manufactured by Greenco (Deerborn, MI, part no. T-3238-BA-2). Other pneumatic cylinders that are constructed with a carriage that incorporates linear bearings may also be employed.

The rate of ascent of the pneumatic cylinder apparatus 3 is controlled by adjusting the flow control button 4, which is part of the pneumatic operator control 2. The setting of flow control button 4 controls the rate of air exhaust out of cylinder 5 which controls the rate of air entry into cylinder 5.

The pneumatic operator control 2 also comprises a start button 6, an emergency stop toggle switch 7 and a pressure gauge 8. A valve 17 (Clippard No. R-401) in the pneumatic operator control 2 responds to signals from (a) a whisker valve 10 on a scale 11; (b) the emergency stop toggle switch 7 and (c) the pressure gauge 8 so that signals from any of these cause the opening to the liquid source 12 to close because either (a) the desired volume of liquid has been dispensed; (b) the operator has signaled there to be an emergency stop; or (c) there is too little pressure in the system. Pushing the start button 6 on the pneumatic operator control 2 charges the pneumatic system with air. The preferred whisker valve 10 is that obtained from Clippard Instrument Laboratory, Inc. (Cincinnati, OH, part no. MW-1) or a similar valve. References to Clippard part numbers hereafter refer to preferred valves for this invention that may be obtained from this company.

Figure 3:
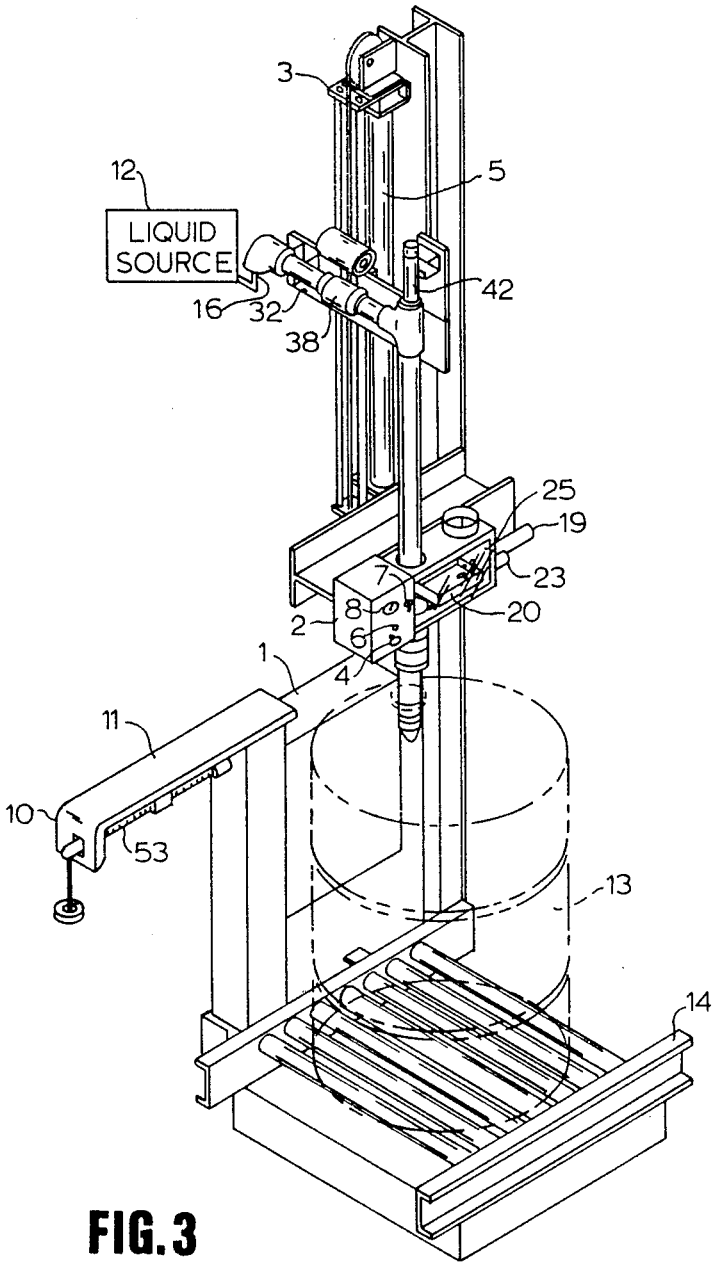
FIG. 3 is a perspective drawing of the subsurface filler of the invention.

The device of the present invention is best understood by a sequential description of its means of operation. As shown in FIG. 3, a barrel 13 or other liquid container is placed on the conveyor 14 which is located above the weighing platform of a scale 11 and the opening of the barrel 13 is aligned with the filling lance 15. This placement may be manual or automatic by known means. The desired final gross weight of the fluid and the barrel 13 is set on scale 11 by adding and/or moving the weights on the balance beam of the scale 11. Scale 11 may be any type of scale with mechanical, non-electronic linkages that is capable of being used with a pneumatic control such as the beam balance shown in FIG. 3.

Figure 4:
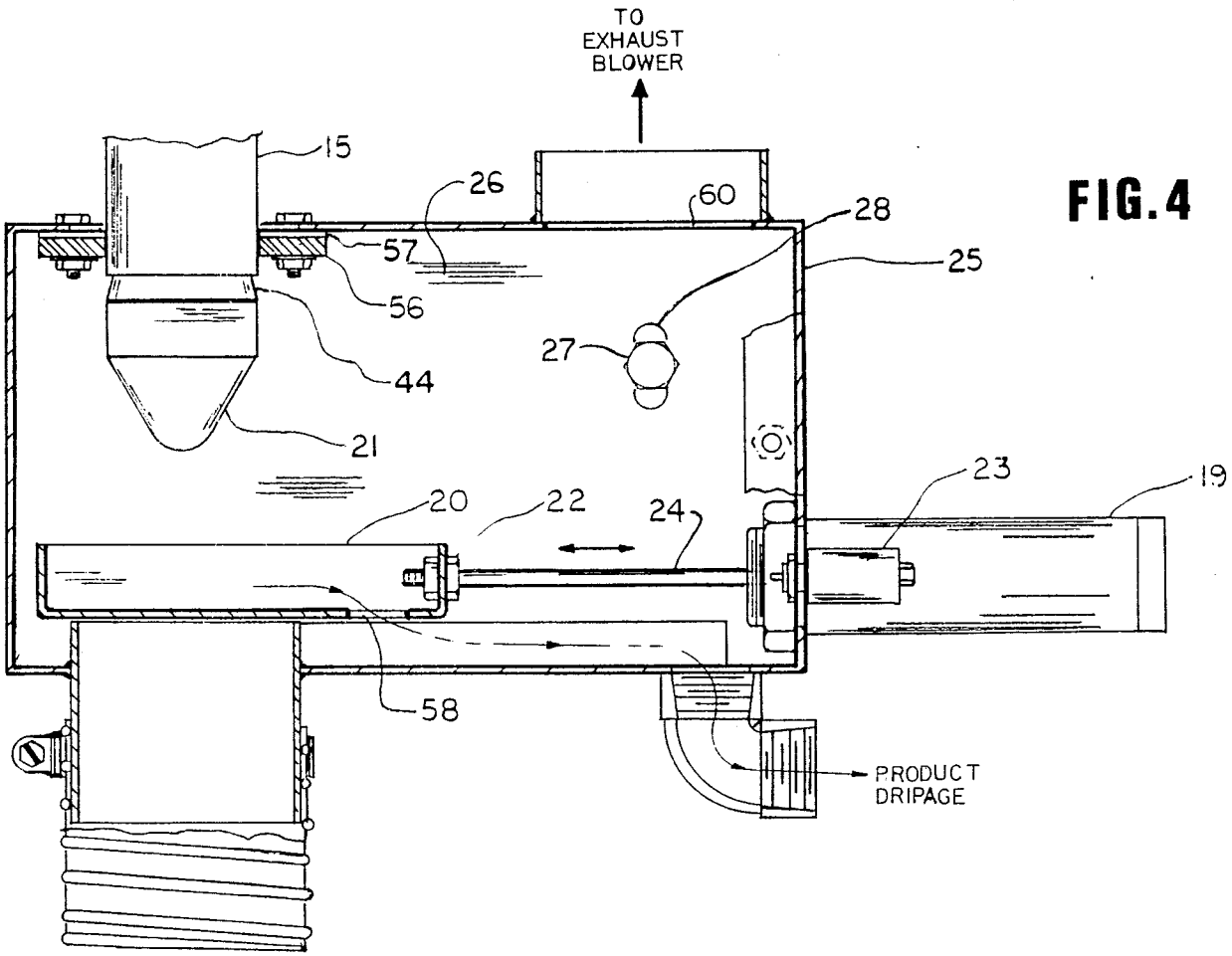
FIG. 4 is a cross-sectional view of the exhaust/drip tray box.

The liquid source 12 to be dispensed into the barrel 13 is then connected to the liquid port 16 of the apparatus, if it is not already on line. The operator pushes the start button 6 to begin the filling sequence. Pushing the start button 6 causes a pneumatic signal to go to valve 17 in the pneumatic operator control 2, which activates valve 18 (Clippard No. R-402) which causes the drip tray cylinder 19 to slide and move the drip tray 20 out of position beneath lance plunger 21 of lance 15 (FIG. 4). As the drip tray 20 moves back to the right (in the view shown in FIG. 4), nut/bolt 22 hits the drip tray limit switch 23. Nut/bolt 22 may be adjusted in position along rod 24 allowing the position of the drip tray 20 at which nut/bolt 22 hits limit switch 23 to be adjustable to align the tray position properly. This adjustment and other adjustments within the exhaust/drip tray box 25 are easily accomplished by removal of the transparent glass or plastic front 26 of the exhaust/drip tray box 25, which is held in place by bolts 27 in mounting holes 28 and is easily removable. The drip tray 20 is also easily removed in the apparatus of the invention by removing the front cover 26 of the exhaust/drip tray box 25 unlike in U.S. Pat. No. 4,337,802 where the drip tray is inside a metal casing ("box arrangement").

Limit switch 23 is connected by means of pneumatic tubing (not shown) to the pneumatic sequencer control box 1 so that when limit switch 23 is tripped by nut/bolt 22, a signal is sent to the pneumatic sequencer control box 1 that then sends a signal to valves 29–31 (Clippard Nos. R-711 and R-324, and Ceram No. 100203535, Wabco Fluid Power, Lexington, KY, respectively), causing cylinder 5 and carriage 32 on the pneumatic cylinder apparatus 3 to begin to be lowered.

Figure 5:
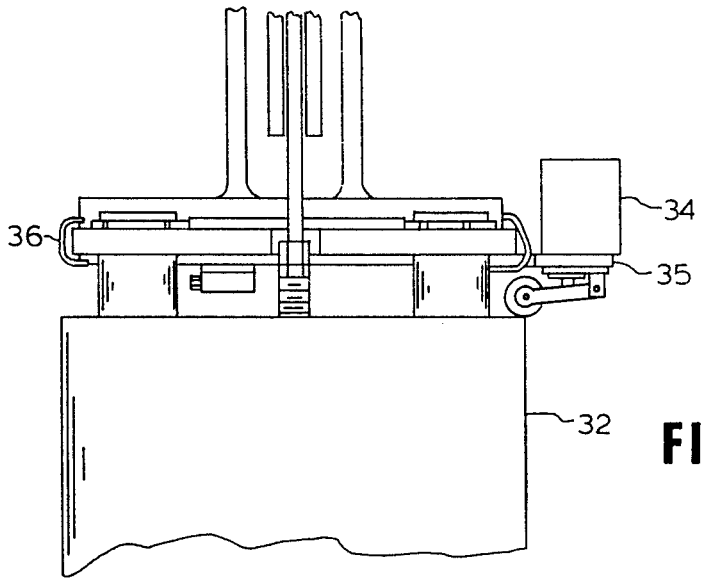
FIG. 5 is a cross-sectional view of the upper limit switch area on the pneumatic cylinder.
Figure 7:
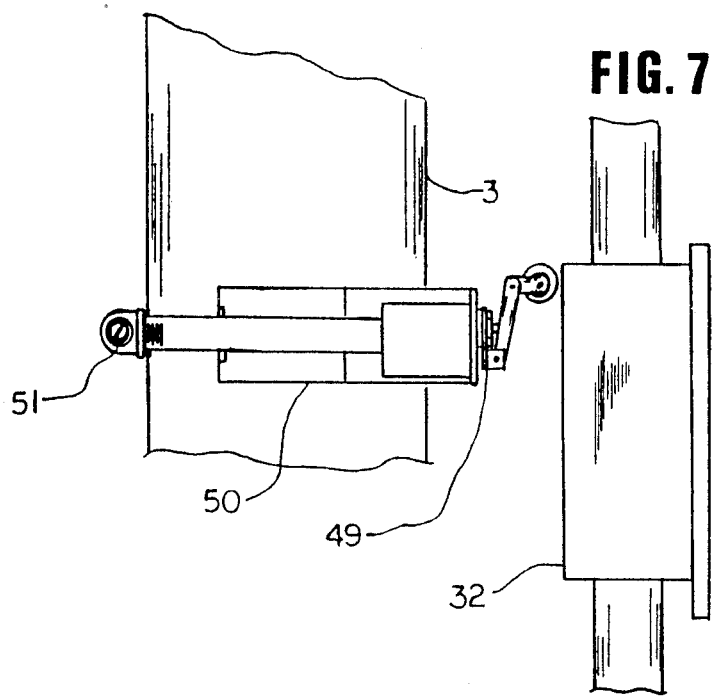
FIG. 7 is a cross sectional view of the middle limit switch.

As the cylinder 5 is lowered, lance 15 moves into the barrel 13 until the lance tip 33 reaches the desired distance from the bottom of the barrel 13. As shown in FIG. 5, limit switch 34 is attached by means of end limit switch bracket 35 and hose clamp 36 to the pneumatic cylinder apparatus 3 so that when the lance tip 33 reaches the desired distance from the bottom of the barrel 13, the bottom of the carriage 32 hits limit switch 34. This sends a pneumatic signal to the pneumatic sequencer control box 1. This portion of the control of the apparatus operations is termed the first control means.

When lance 15 is at the desired lowered position and the pneumatic sequencer control box 1 receives the signal from limit switch 34, valve 37 (Clippard No. R-302) sends a pneumatic signal to two places. First, it activates valve 38 to access the liquid source 12. The line 39 between the liquid source 12 and the pipe 40 is opened so that product may come into the filling lance 15.

Secondly, the pneumatic signal from limit switch 34 activates valve 41 in the pneumatic sequencer control box 1. Valve 41 sends a pneumatic signal to two places. First it activates plug cylinder 42. In the preferred embodiment, plug cylinder 42 is obtained from Allenair Corp. (Mineola, N.Y., part no. SSE-1-$\frac{1}{2}$×4-WR-Q-HTP-B-H=45-$\frac{1}{2}$). Activation of plug cylinder 42 causes the cylinder rod 43, lance plunger gasket 44 and the lance plunger 21 to be pushed downward away from the pipe 40 so that the lance tip 33 is opened and liquid product may come out the end of the lance 15 at the end of pipe 40. Lance 15 is provided with centering pins 45 so that the position of the cylinder rod 43 within the pipe 40 may be easily adjusted to avoid misalignment or hanging up of the lance plunger gasket 44 in pipe 40. Lance plunger gasket 44 is preferably made of teflon for proper sealing, and therefore is one of the few items that must be replaced periodically. Unlike prior subsurface fillers having inaccessible nuts and lockwashers or other mechanisms to hold the lance plunger on the lance, and which require opening of the lance tip to replace the plunger/seal, the lance plunger 21 of this invention is threaded on the cylinder rod 43 and is held on with one or more set screws 46 which are easily accessible. Set screw 46 engages a flattened side of the cylinder rod 43.

Because the plug cylinder 42 must be isolated from the liquid product to protect it from corrosion or other damage, double teflon O-rings 47 are placed at the upper end of the cylinder rod 43 to seal the interior of pipe 40 from the plug cylinder 42. These O-rings 47 are positioned so that they are easy to change and to tighten by turning the plug cylinder 42 In other subsurface fillers, the shaft seal is difficult to tighten and to replace. For example, in U. S. Pat. No. 4,337,802, the analogous seal is inside a T-fitting and adaptor.

The second signal that valve 41 causes to be sent starts the timer 48 (Clippard No. R-331). The timer 48 is preset so that after a predetermined amount of time, related to the rate of filling, a pneumatic signal is sent to valve 31 in the pneumatic sequencer control box 1, which sends a pneumatic signal to cause pneumatic cylinder apparatus 3 to begin rising. The rate of rise of pneumatic cylinder apparatus 3 may be determined in advance by the operator by adjusting flow control button 4 or it may be varied in the same manner while the filling operation is in progress. The barrel 13 continues to fill during this rising of the pneumatic cylinder apparatus 3.

Figure 6:
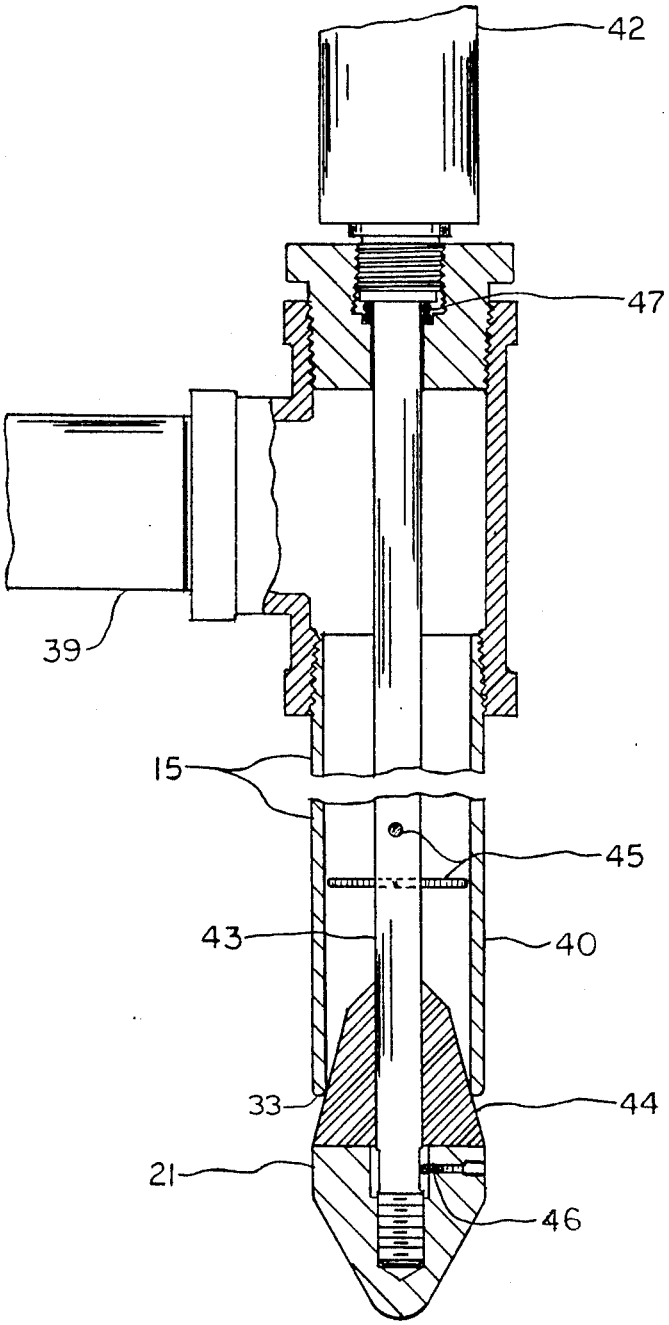
FIG. 6 is a side cross-sectional view of the lance.

When the position of the pneumatic cylinder apparatus 3 reaches a position where the lance tip 33 is still in the barrel 13, but is below the level of the liquid, the carriage 32 hits limit switch 49, causing another signal to be sent to the pneumatic sequencer control box 1. Limit switch 49, shown in FIG. 6, is clamped to the pneumatic cylinder apparatus 3 by means of bracket 50 and hose clamp 51. An advantage of this limit switch arrangement, which differs from that of the prior art, is that the position of the limit switch 49 on the pneumatic cylinder apparatus 3 may be adjusted. This is particularly useful if drums or barrels of different sizes are used with the invention. Other advantages of this type of external attachment for the limit switch are that it does not require machining and is easily attached. Thus, the lance 15 may rise to a predetermined one of a number of levels before limit switch 49 is triggered. This portion of the control of the apparatus operations is termed the second control means.

When limit switch 49 is triggered, it sends a signal to pneumatic sequencer control box 1 to valve 31 to signal the rising of the lance 15 to stop. Valve 31 is a four-way "center-off" type of valve, such as is manufactured by American Standard.

The barrel 13 continues to be filled until the gross weight of the barrel 13 and the liquid reaches the preset weight and at this point the beam 53 on the scale 11 hits whisker valve 10. This causes the air pressure to be exhausted from the circuit by means of valve 17 in the pneumatic operator control box 2. A signal is sent back to the pneumatic sequencer control box 1 to valve 37 causing valve 38 to close. Valve 37 has springs (not shown) inside it. Thus, if pressure is lost in the system, valve 38 will also close automatically and stop the filling. A signal is also sent from valve 17 to valve 54 (No. V-3216, Air Mite Devices, Inc., Chicago, IL).

Valve 17 also signals the timer 55 (Clippard No. R-331) that the dwell time is to begin. The dwell time of approximately 10 seconds (or more or less depending on the liquid) allows liquid to drain from the lance 15 between the time the liquid flow stops and the lance 15 is plugged and withdrawn from the barrel 13. The length of the dwell time is adjusted by timer 55. At the end of the preset dwell time, a pneumatic signal is sent to the plug cylinder 42 causing cylinder rod 43, lance plunger gasket 44, and lance plunger 21 to be withdrawn into pipe 40, so that the product may no longer come out of the lance tip 33. This closure of the lance tip 33 is by air pressure and does not rely on a spring to close the plug as is disclosed by Kennedy. This spring in the prior filler must be specially machined as must the nuts and bolts between the spring and actuator of the Kennedy filler. In addition, the signal from the timer 55 causes the whole carriage 32 to be lifted so that the lance 15 is removed from the barrel 13.

The carriage 32 continues to rise until it hits limit switch 34 (FIG. 5). This portion of the control of the apparatus operations is termed the third control means. When limit switch 34 is hit, a pneumatic signal is sent to valve 18 in the pneumatic sequencer control box 1 to cause the drip tray 20 to be moved under the tip of the lance 15 into the position shown in FIG. 4 to catch drips of the liquid being dispensed. Lance guide 56 serves as a liquid wiper as lance 15 is withdrawn. Lance guide 56 is made of teflon and acts a sealing gasket so that excessive product carried on the exterior of the lance is not withdrawn when the lance is drawn upward. This teflon lance guide 56 is easily replaced by unbolting the front cover of the exhaust/drip tray box 25. This differs from the subsurface filler of Kennedy et al. (U.S. Pat. No. 4,337,802) in which the top plate around the lance must be unbolted from the box arrangement to remove the wiper ring and therefore the lance guide is not as easily accessible and replaceable as that of this invention.

Any liquid that remains on the exterior of the lance 15 as it is withdrawn from the exhaust/drainage box 25 and that drains downward is collected in groove 57 on lance guide 56 (FIG. 4). The vacuum formed by the exhaust system causes this liquid to be pulled off the lance guide 56 into the exhaust/drip tray box 25. Any excessive liquid drainage in the exhaust/drip tray box 25 flows from the tray 20 through hole 58 in the bottom of the tray or from elsewhere in the exhaust/drip tray box 25 out the bottom of the exhaust/drip tray box 25 into a collection container (not shown).

The circuitry is reset automatically when a signal from valve 18 is sent to valve 59 (Clippard No. R-302) so that another barrel may be filled. The operator or a manual or automatic barrel moving mechanism (not shown) moves the barrel from under the lance 15 so that another barrel may be positioned there.

In addition to those discussed above, certain features of the invention provide significant improvements in maintenance characteristics. In the invention, because the drip tray cylinder 19 that controls movement of the drip tray 20 is exterior to the exhaust/drip tray box 25, it is not exposed to product vapors, and therefore is not corroded or otherwise hurt. The piston-cylinder of the Kennedy patent (4,337,802) is inside the chamber where exhaust fumes are present.

The cylinders, the drip tray 20, the drip tray box 25, the lance 15 and valve 38 are preferably constructed of stainless steel to minimize the corrosion due to toxic chemicals used in the apparatus. For particular operations using acids, the parts of the apparatus that come into contact with the liquid being dispensed may be made of PVC or other resistant materials.

With the exception of the teflon lance plunger gasket 44 on the lance head, the parts used in making the invention are off-the-shelf parts or stainless steel long term wearing parts and do not need to be specially machined to make the invention.

The invention also provides certain novel precautionary features. One such feature keeps the filling process from continuing if the drip tray 20 is in the wrong position. In the apparatus of the invention, the limit switch 23 on the drip tray 20, means that no signal is given for the lance 15 to begin downward movement until the tray has moved sufficiently out of the way of the lance tip.

Another safety feature of the invention is the efficient exhaust removal system. Preferably the exhaust/drip tray box 25 of the invention has a three-inch exhaust hole 60 to the exhaust blower (not shown). This enables vapors of noxious and hazardous chemicals to be quickly removed from the exhaust/drip tray box 25. Typical prior subsurface fillers have very small holes through which to remove vapors. In Kennedy (4,337,802), the fumes must be drawn through a holes in an H-beam and a closed chamber.

A major safety feature of the invention is the total absence of non-pneumatic switches. Thus, there is not possibility of a signal sent to an electronic switch causing an explosion. Even the Kennedy patent, which is mostly pneumatically controlled, has mechanical or electronic signal elements on the scale. Fumes often build up in the rooms in which subsurface filling operations are occurring so that even an electronic signal on a scale may be hazardous. Other prior subsurface fillers, such as that of Reeves (U.S. Pat. No. 4,703,780) utilize non-pneumatic signals to signal lance movement or tray movement. These fillers then must either have explosion-proof valves or only be used with appropriate compounds of appropriate TLV's. Thus, the entirely pneumatic filler of the invention may be used with much lower TLV compounds than previous fillers.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. An apparatus for subsurface filling of a container with a liquid from a liquid source comprising:

(a) a pneumatic cylinder apparatus, said pneumatic cylinder apparatus having a lance, said lance having an openable and closable lance tip;

(b) a drip tray pneumatically movable with respect to said lance tip and positionable under said lance tip;

(c) a timer means that may be preset to send a first pneumatic timer signal and a second pneumatic timer signal; said first timer signal causing the lance to ascend after a period of elapsed time, and said second timer signal causing (i) closure of the lance tip after a preset dwell time after the second timer signal is started; and (ii) ascent of the lance after the lance tip is closed;

(d) a weighing means, said weighing means providing a pneumatic signal when a preset weight of a container and liquid is achieved, said weighing means comprising a pneumatic whisker valve and a scale, said whisker valve being activated by the scale to send a pneumatic signal to cause the second timer signal to start when the preset weight is achieved;

(e) a start means having a response to a start signal, said response of said start means comprising (i) a pneumatic signal to cause the drip tray to move from beneath the lance tip; and (ii) a pneumatic signal to cause the lance to move downward;

(f) a first control means having a response to downward movement of the lance to a first position; said response of the first control means comprising: (i) a pneumatic signal to open the liquid source to the lance; (ii) a pneumatic signal to open the lance tip to release liquid into the container; and (iii) a pneumatic signal to start the timer means to send the first timer signal;

(g) a second control means having a response to upward movement of the lance to a second position, said response of said second control means comprising a pneumatic signal to the lance to cease its upward movement;

(h) a third control means having a response to the upward movement of the lance to a third position above the second position; said response of said third control means comprising a pneumatic signal to move the drip tray under the lance tip;

(i) a pneumatic sequencer control box having a response to pneumatic signals from (i) said first, second and third pneumatic control means; (ii) said whisker valve; and (iii) said timer means; and (j) an adjustable flow control means for controlling a rate of exhaust and a rate of movement of the lance;

wherein a pneumatic operator control provides a means for causing cessation of the liquid flow (i) in response to said second timer signal; (ii) in response to pressure decreases in the apparatus; and (iii) in response to activation of an emergency switch.

2. An apparatus for subsurface filling of a container with a liquid according to claim 1, wherein said drip tray is within a drip tray box, said drip tray is pneumatically controlled by a drip tray cylinder, said drip tray cylinder is external to the drip tray box, said drip tray cylinder is activatable by the start means, activation of said drip tray cylinder by the start means causes the drip tray to move from beneath the lance tip, and activation of the drip tray cylinder by the third control means causes the drip tray to move beneath the lance tip.

3. An apparatus for subsurface filing of a container with a liquid according to claim 2, further comprising a lance guide on the drip tray box, said lance guide having a groove for removing excess liquid from the outside surface of the lance.

4. An apparatus for subsurface filling of a container with a liquid from a liquid source, comprising:

(a) a pneumatic cylinder apparatus, said pneumatic cylinder apparatus having a lance, said lance having a openable and closable lance tip;

(b) a drip tray pneumatically movable with respect to said lance tip and positionable under said lance tip;

(c) a timer means that may be preset to send a first pneumatic timer signal and a second pneumatic timer signal; said first timer signal causing the lance to ascend after a period of elapsed time, and said second timer signal causing (i) closure of the lance tip after a preset dwell time after the second timer signal is started; and (ii) ascent of the lance after the lance tip is closed;

(d) a weighing means, said weighing means providing a pneumatic signal when a preset weight of a container and liquid is achieved, said weighing means comprising a pneumatic whisker valve and a scale, said whisker valve being activated by the scale to send a pneumatic signal to cause the second timer signal to start when the preset weight is achieved;

(e) a start means having a response to a start signal, said response of said start means comprising (i) a pneumatic signal to cause the drip tray to move from beneath the lance tip; and (ii) a pneumatic signal to cause the lance to move downward;

(f) a first control means having a response to downward movement of the lance to a first position; said response of the first control means comprising: (i) a pneumatic signal to open the liquid source to the lance; (ii) a pneumatic signal to open the lance tip to release liquid into the container; and (iii) a pneumatic signal to start the timer means to send the first timer signal;

(g) a second control means having a response to upward movement of the lance to a second position, said response of said second control means comprising a pneumatic signal to the lance to cease its upward movement;

(h) a third control means having a response to the upward movement of the lance to a third position above the second position; said response of said third control means comprising a pneumatic signal to move the drip tray under the lance tip;

(i) a pneumatic sequencer control box responsive to pneumatic signals from (i) said first, second and third pneumatic control means; (ii) said whisker valve; and (iii) said timer means; and (j) an adjustable flow control means for controlling a rate of exhaust and a rate of movement of the lance, wherein said drip tray is within a drip tray box, said drip tray is pneumatically controlled by a drip tray cylinder, said drip tray cylinder is external to the drip tray box, said drip tray cylinder is activatable by the start means, and wherein activation of said drip tray cylinder by the start means causes the drip tray to move from beneath the lance tip and activation of the drip tray cylinder by the third control means causes the drip tray to move beneath the lance tip.

5. An apparatus for subsurface filling of a container with a liquid according to claim 4, wherein the drip tray box has a transparent, easily removable front.

6. An apparatus for subsurface filling of a container with a liquid according to claim 4, further comprising a lance guide on the drip tray box, said lance guide having a groove for removing excess liquid from the outside surface of the lance.

* * * * *